US006651396B2

(12) United States Patent
DeRuiter et al.

(10) Patent No.: US 6,651,396 B2
(45) Date of Patent: Nov. 25, 2003

(54) WALL PANEL SYSTEM

(75) Inventors: Phillip DeRuiter, Jenison, MI (US); Pete Beyer, Holland, MI (US); Dave Emery, No. Muskegon, MI (US); Robert Tuttle, Saugatuck, MI (US); Kevin Meyer, Hudsonville, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 10/163,973

(22) Filed: Jun. 6, 2002

(65) Prior Publication Data

US 2002/0148179 A1 Oct. 17, 2002

Related U.S. Application Data

(62) Division of application No. 09/671,837, filed on Sep. 27, 2000, now Pat. No. 6,418,671, which is a division of application No. 09/093,480, filed on Jun. 8, 1998, now Pat. No. 6,148,567.

(51) Int. Cl.[7] ..... H02G 3/04
(52) U.S. Cl. ..... 52/220.7; 52/239; 52/242
(58) Field of Search ..... 52/220.7, 290, 52/239, 242, 36.1; 174/48

(56) References Cited

U.S. PATENT DOCUMENTS

| | | | | | |
|---|---|---|---|---|---|
| 3,464,052 | A | * | 8/1969 | Hukin | 439/215 |
| 3,721,762 | A | * | 3/1973 | Gooding | 174/48 |
| 4,835,915 | A | * | 6/1989 | Nilssen | 52/28 |
| 4,874,322 | A | * | 10/1989 | Dola et al. | 439/210 |
| 5,277,007 | A | * | 1/1994 | Hellwig et al. | 52/220.7 |
| 5,357,053 | A | * | 10/1994 | Manaras | 174/48 |
| 5,994,644 | A | * | 11/1999 | Rindoks et al. | 174/48 |

* cited by examiner

*Primary Examiner*—Carl D. Friedman
*Assistant Examiner*—Basil Katcheves
(74) *Attorney, Agent, or Firm*—Flynn, Thiel, Boutell & Tanis, P.C.

(57) ABSTRACT

This invention relates to a space-dividing wall panel system which includes components which are compatible with various types of wall panels and furniture components therefor. These components include a connector bracket having multiple inserts for supporting furniture components thereon, and an interface assembly also is provided which is compatible with various wall panel systems. A spiral cable manager also is provided for supporting cabling within the wall panels.

23 Claims, 10 Drawing Sheets

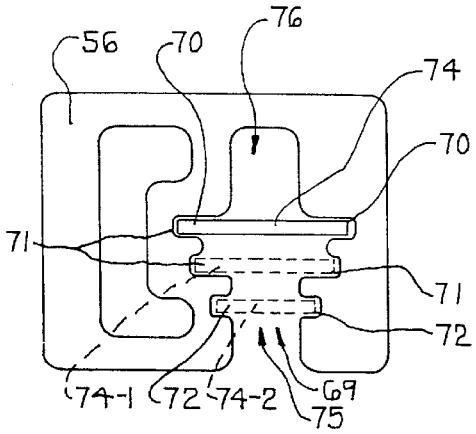
FIG.6
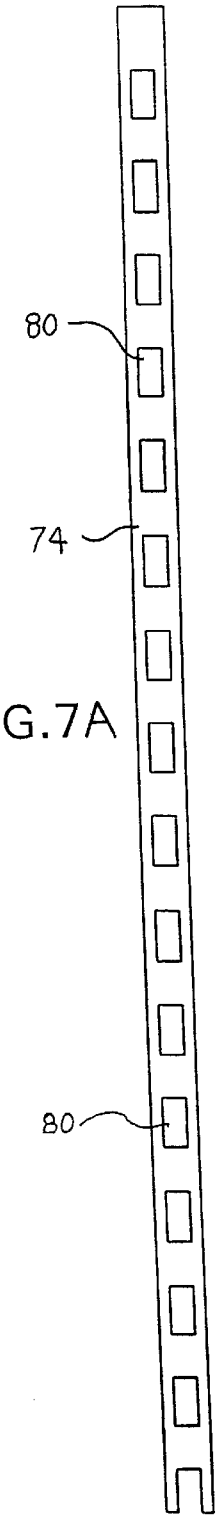
FIG.7A
FIG.8
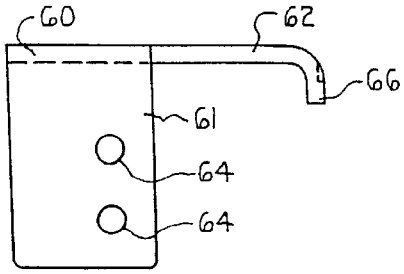

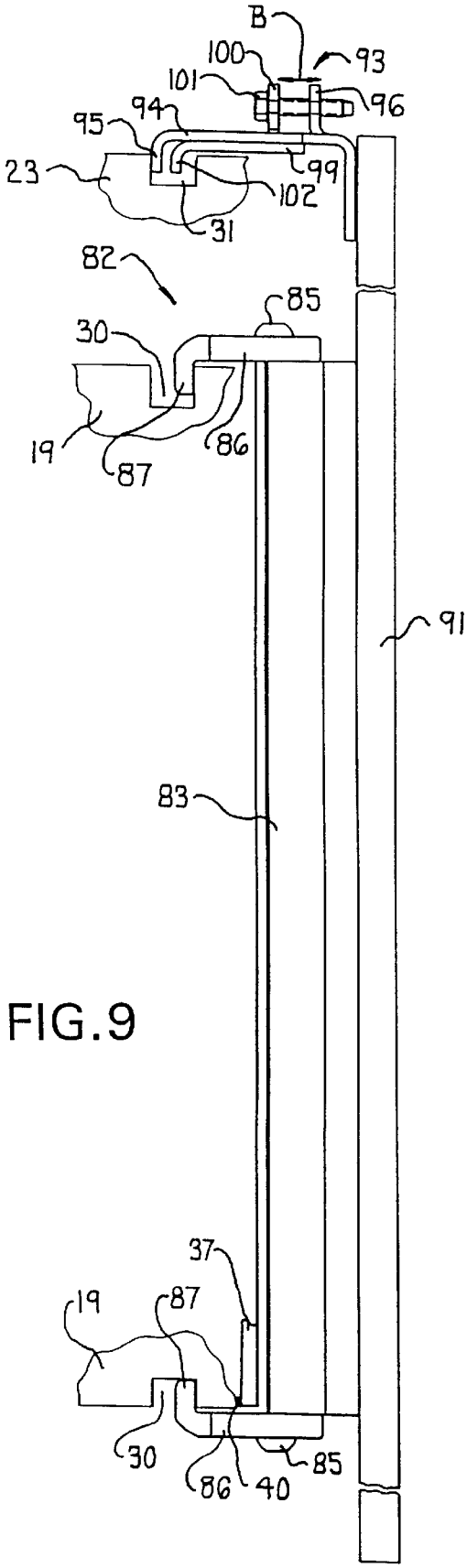
FIG.9
FIG.10
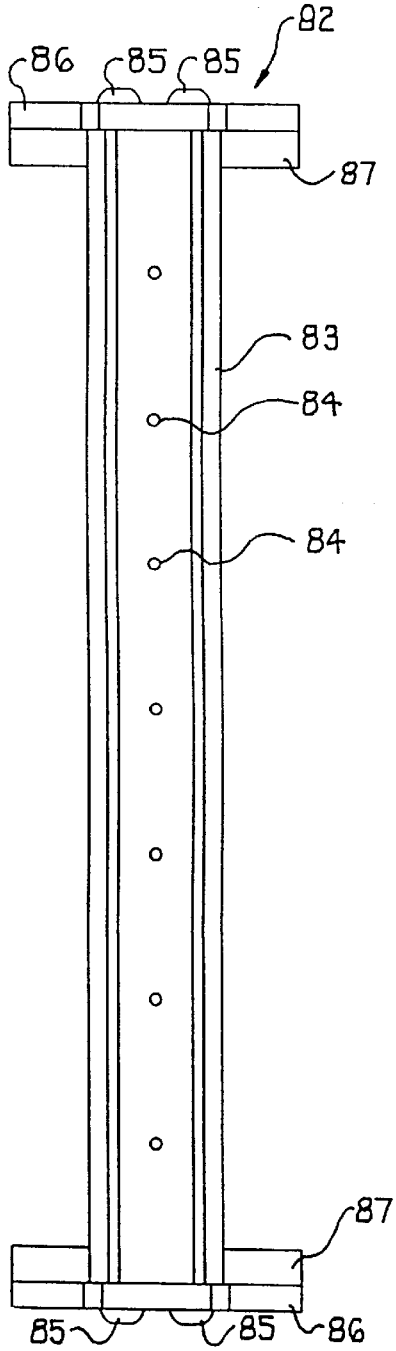

WALL PANEL SYSTEM

CROSS REFERENCE TO RELATED APPLICATIONS

This is a division of Ser. No. 09/671,837, filed Sep. 27, 2000, now U.S. Pat. No. 6,418,671, which is a division of Ser. No. 09/093,480, filed Jun. 8, 1998, now U.S. Pat. No. 6,148,567.

FIELD OF THE INVENTION

This invention relates to a space-dividing wall panel system, and in particular, to an arrangement of wall panels having brackets supported on the wall panels for supporting various furniture components and for managing cabling.

BACKGROUND OF THE INVENTION

Commercial buildings typically include large open office areas which are divided into smaller work spaces or workstations by any of a number of space dividing panel systems that have been developed therefor. These space divider arrangements typically employ upright space-dividing wall panels which serially connect together to subdivide the office area into a plurality of smaller workstations of a desired size and configuration.

Conventional wall panel systems, however, often use different types of connectors to join the ends of two wall panels together and to support or hanging various furniture components, such as overhead storage units, on the wall panels. As a result, different wall panel systems often are not compatible one with the other.

One space-dividing wall panel system, however, which is usable with different products is disclosed in U.S. patent application Ser. No. 08/736,512. This panel system functions particularly well as a spine wall system. A spine wall runs the length of a group of workstations and supports space-dividing return walls on opposite sides of the spine wall to define individual workstations. These spine walls also have a significant cabling capacity so as to allow communications and power cabling to be laid along the length of the spine wall and be supplied to the return walls branching therefrom.

While the return walls may be formed from wall panels having the same construction as the wall panels which define the spine wall, the return walls may also be constructed from other styles and brands of wall panels from the same or different manufacturers. For example, the spine wall not only accommodates many of the various wall panel systems and associated furniture components supplied by Haworth, Inc., the assignee of the present application, but this spine wall also may accommodate wall panel systems and components sold by other manufacturers.

To permit various types and brands of furniture components to be connected to this spine wall system while minimizing the number of system components, the wall panel system disclosed herein includes brackets for supporting various furniture components and return walls, which are used in conjunction with the wall panels disclosed in the above-identified patent application.

One bracket is a connector bracket that removably mounts to a wall panel and supports furniture components, such as storage cabinets and shelves, on the wall panel. Generally, conventional furniture components for wall panel systems typically include hooks which slide into corresponding slots on a wall panel so that the furniture component is connected or supported thereon. These hook and slot arrangements, however, may have different sizes and spacings for the hooks and slots depending upon the particular manufacturer or even the particular product sold by a single manufacturer. Thus, an arrangement of slots on one panel system accommodates components having a specific arrangement of hooks, but typically is not compatible with components having a different arrangement of hooks.

The connector bracket disclosed herein overcomes these differences by incorporating a vertical support rail which has a plurality of slots therein so as to accommodate a plurality of different inserts. Each insert has vertically spaced slots that correspond to a particular arrangement of hooks. Thus, if a particular furniture component is to be supported, the insert corresponding thereto is slid into one of the bracket channels such that the connector bracket is compatible therewith. These inserts can be replaced with alternative inserts which accommodate different types of furniture components.

While this connector bracket may be used with return walls, an interface bracket assembly for return walls also is disclosed herein. This interface bracket includes a mounting bracket which mounts to the spine panel. To secure a return wall to the mounting bracket, a vertical interface rail is mounted to the mounting bracket.

Since different wall panel systems also use different connector arrangements at the ends of wall panels to serially-connect the wall panels together, the interface rail is provided so as to connect to the specific wall panel connector arrangement being used on the return wall. Thus, one or more different types of interface rails are provided which are compatible with the different types of wall panels available.

Since the mounting rail connects to horizontal channels on a wall panel, this interface bracket further includes a disengagable panel lock thereon, preferably on the interface rail to prevent sliding of the mounting rail and facilitate adjustment of the return wall so that it is plumb. The panel lock includes movable jaws which may be spread apart to frictionally engage the walls of a horizontal channel on the wall panel and thereby prevent movement of the interface bracket.

To manage cabling which is stored in the wall panels, the wall panel system further includes cable rings which mount to the wall panel frame so as to support and manage the cabling within the panel raceways. The cable rings have a spiral shape to permit the cable to first be laid through the raceways and then slid sidewardly into the rings. No fishing of the ends of the cables through the ring is necessary such that the cable is readily secured in the cable ring after the cable is already laid.

The wall panel system therefore includes a number of components as disclosed herein which are compatible with different furniture components and wall panel systems. Other objects and purposes of the invention, and variations thereof, will be apparent upon reading the following specification and inspecting the accompanying drawings.

BRIEF DESCRIPTION OF THE DRAWINGS

FIG. 6 is a plan view of a vertical rail of the connector bracket.

FIG. 7A is a front elevational view of a first insert for the vertical rail.

FIG. 8 is a side elevational view of a hook for the connector bracket.

FIG. 9 is a broken side elevational view of a return wall interface bracket.

FIG. 10 is a front view of a mounting bracket for the interface bracket.

Figure 1:
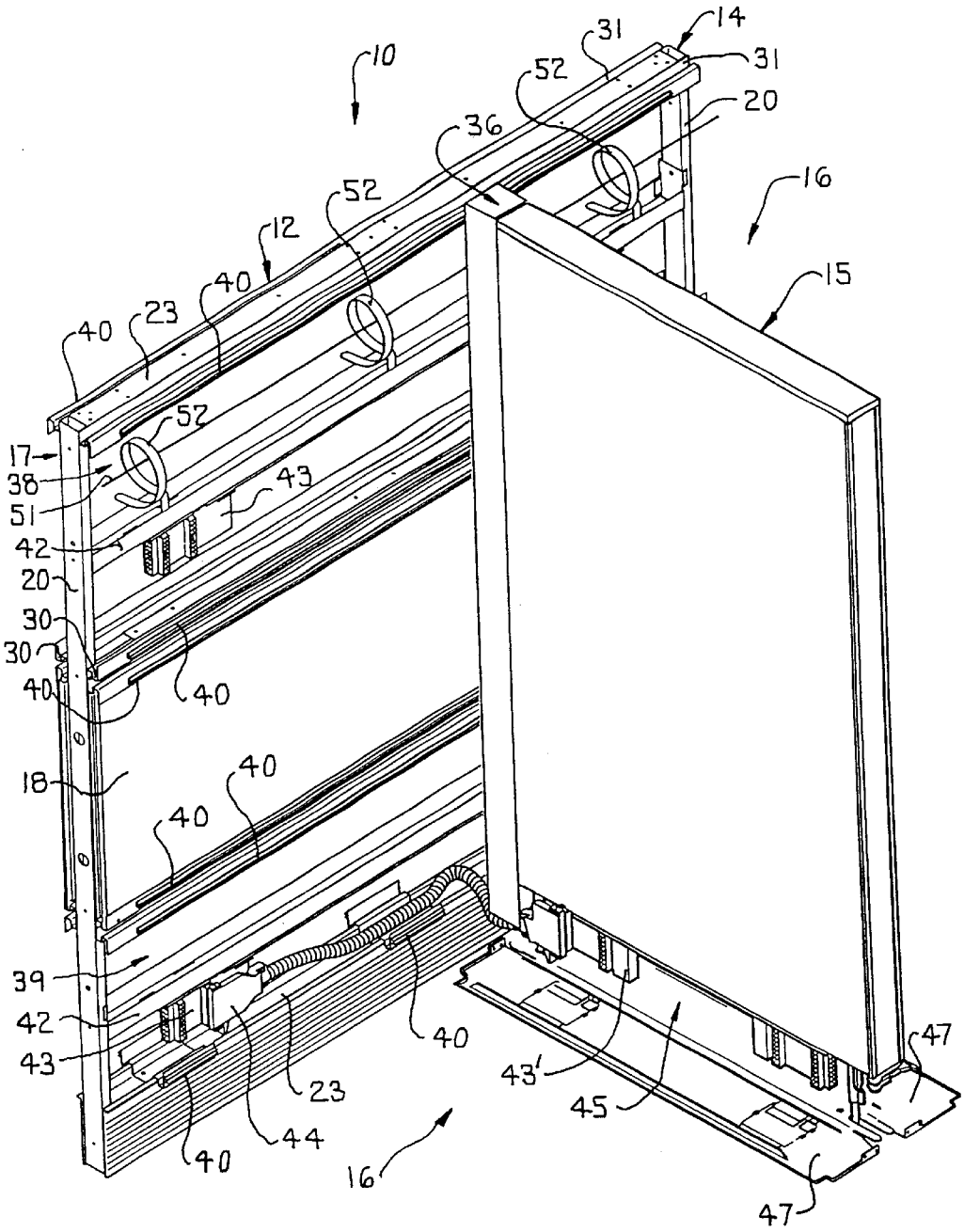
FIG. 1 is a front perspective view illustrating a wall panel and a return wall of a space-dividing wall panel system of the invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, the invention relates to a space-dividing wall panel system 10 for subdividing an office area. The wall panel system 10 includes a selected number of upstanding wall panels 12 one of which is illustrated in FIG. 1. The wall panels 12 are adapted to be serially connected together to define a primary space-dividing wall 14 having substantial load-bearing and cable-carrying capacities, said wall 14 being commonly referred to as a "spine wall" and being provided in combination with return walls 15 for subdividing the office area into separate workstations 16.

The wall panel system 10 including the wall panel 12 is generally disclosed in U.S. patent application Ser. No. 08/736,512, entitled PANEL ARRANGEMENT, the disclosure of which in its entirety is incorporated herein by reference. The structure and function of the wall panel system 10 disclosed herein is substantially the same as that disclosed in the above-identified patent application with the following disclosure being directed to additional inventive components of the system.

Generally with respect to the wall panel system 10, each wall panel 12 is formed with a structurally rigid and strong rectangular frame 17 having a box-like beam 19 which extends horizontally between laterally spaced vertical uprights 20. Additionally, upper and lower cross rails 23 are connected to the upper and lower ends of the uprights 20 in vertically spaced relation to the box-beam 19. Additional cross rails 23 are connected to the uprights 20 directly above and below the box-beam 19. The wall panel 12 thereby has significant rigidity and strength to readily support furniture components 25 as well as the return walls 15 which, when loaded with their own respective furniture components (not illustrated) and connected to the spine wall 14, transfer a significant torsional load thereto.

Each wall panel 12 also permits continuous off-modular adjustment of each return wall 15 (FIG. 1) and furniture component 25 (FIG. 2) along the spine wall 14. In particular, the top and bottom of the box-beam 19 include a pair of parallel horizontal channels 30 along the longitudinal length thereof. Each of the cross rails 23 similarly include a pair of horizontal channels 31.

The horizontal channels 30 and 31 are spaced outwardly of the uprights 20 in non-interfering relation therewith. Each channel 30 or 31 preferably opens upwardly or downwardly and has opposite open ends which align with corresponding open ends of the channels of a serially-adjacent wall panel.

A connector bracket 35 is used to slidably connect each furniture component 25 to the wall panel 12 while an interface assembly 36 is provided for the connection of the return wall 15. The connector bracket 35 as well as the interface assembly 36 mount to and are slidable in the channels 30 and 31 for adjusting the position of these components.

While many wall panel systems are not compatible with furniture from other manufacturers, the wall panels 12 can accommodate a wide variety of other furniture systems and components. To provide this compatibility, the connector bracket 35 and the interface assembly 36 are compatible with other systems as described herein.

The channels 30 and 31 thereby define respective upper, intermediate and lower mounting locations for slidably connecting each connector bracket 35 and interface assembly 36 to the spine wall 14. Due to the continuous, uninterrupted configuration of the channels 30 and 31, the brackets 35 and 36 are readily slidable not only along each individual wall panel 12 but also along the entire length of the spine wall 14. This continuous off-modularity provided by the channels 30 and 31 permits ready repositioning of the brackets 35 and 36 and thereby permits repositioning of each furniture component 25 or return wall 15 which need not be removed from the spine wall 14 to allow for repositioning.

The wall panels 12 also define horizontal raceways 26 and 27 (FIG. 5) above and below the box-beam 19 which are enclosed by removable panel covers or tiles 37 (FIG. 9) that connect to cover connectors 40. As a result, each wall panel 12 has a significant cable carrying capacity.

More particularly, as seen in FIG. 1, the wall panel 12 supports power and telecommunications cabling within the raceways 26 and 27. The base panel 12 includes a cable support rail 42 extending between the uprights 20 and a conventional power distribution assembly (PDA) 43 supported on the rail 42. A power connector cable 44 has one end connected to the lower PDA 43 and the opposite end connected to a further PDA 43' which is disposed in a horizontal base raceway 45 in the return wall 15. The base raceway 45 is accessible from opposite sides of the return wall 15 through removable covers 47.

The upper raceway 38 also includes one or more telecommunications cables 51 extending horizontally therethrough. To manage the cables 51, a plurality and preferably three, cable rings 52 are supported in the raceway 38, for example, on top of the cable support rail 42. The cable rings 52 also may be connected to the bottom of a rail 42 so as to project downwardly therefrom.

Thus, the spine wall 14 provides the primary load-bearing and cable-carrying capacity of the wall panel system 10. The return walls 15 are branched off from the spine wall 14 to define the separate workstations 16 and route cabling, such as cables 44 and 43', which are received from wall panels 12 to these workstations 16.

Due to this increased capacity, this system 10 thereby may be used as a central spine wall for supporting existing return walls and associated components from various manufacturers. The connector bracket 35 and the interface assembly 36 are provided to overcome the difficulties associated with incompatible wall panels while reducing the number of component parts.

More specifically, in conventional wall panel systems, such furniture components typically have a vertical row of spaced apart hooks projecting rearwardly therefrom. The wall panels to which the furniture component is to be supported include slots which correspond to the hooks which generally is referred to herein as a hook and slot arrangement. An example of a wall panel system having a hook and slot arrangement is disclosed in U.S. Pat. No. 4,660,477, the disclosure of which in its entirety is incorporated herein by reference.

In a conventional wall panel, these slots may be provided, for example, in the vertical rail of a panel frame or an intermediate post which supports two wall panels on the opposite side thereof. As previously discussed, there are a number of systems having different slot and hook arrangements, which, for example, may have different hook and slot sizes, widths and spacings. More generally, the hooks and slots serve as connector parts and thereby define different connector arrangements depending upon the arrangement of the hooks and slots.

Figure 2:
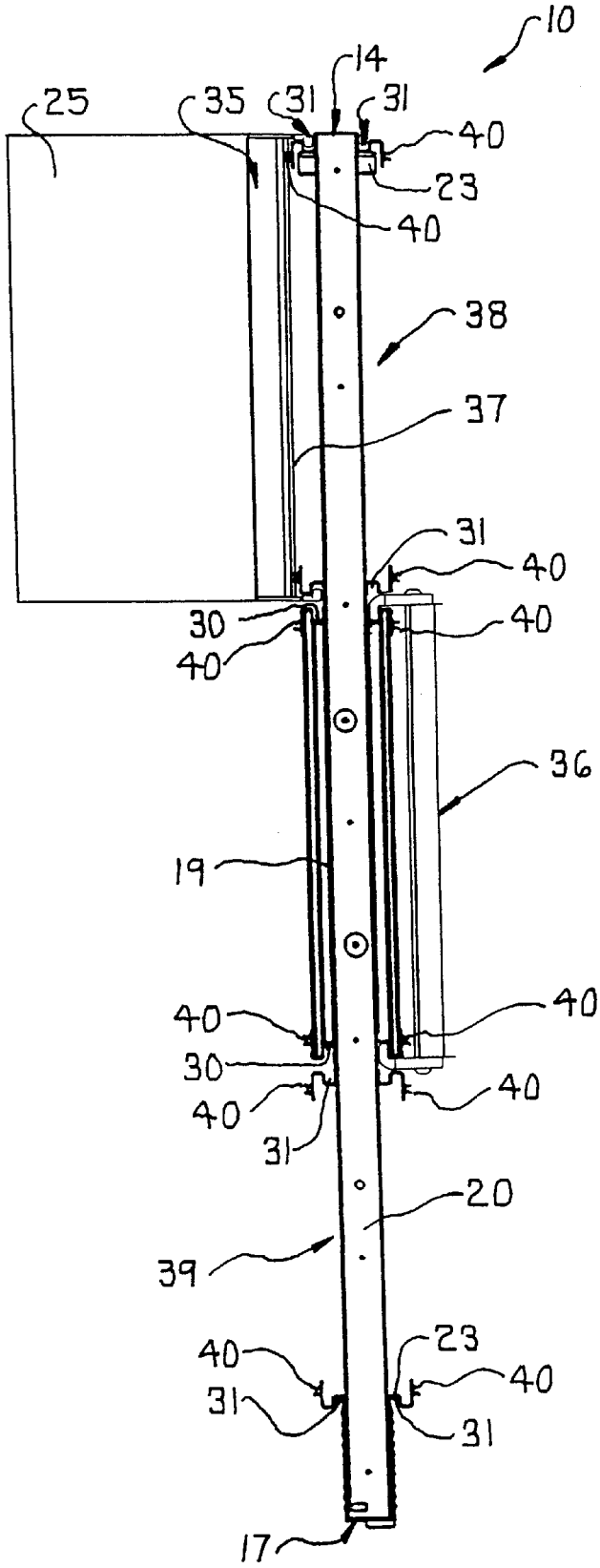
FIG. 2 is a side elevational view illustrating the wall panel with a furniture component mounted thereto.

With respect to the connector bracket 35, this bracket 35 is provided to define a mounting location for various types of furniture components such as overhead storage units, shelves, storage racks or the like. The furniture components 25 are removably connected to the connector bracket 35 such that, while FIG. 2 illustrates an overhead storage unit suspended therefrom, other furniture components may also be supported thereon. While these other furniture components might have different connector or mounting arrangements, the connector bracket 35 is compatible with a variety of connector or mounting arrangements as discussed herein.

Figure 4:
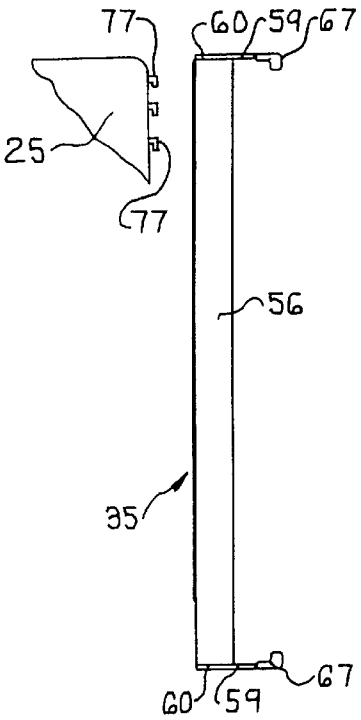
FIG. 4 is a right side view of the connector bracket.
Figure 5:
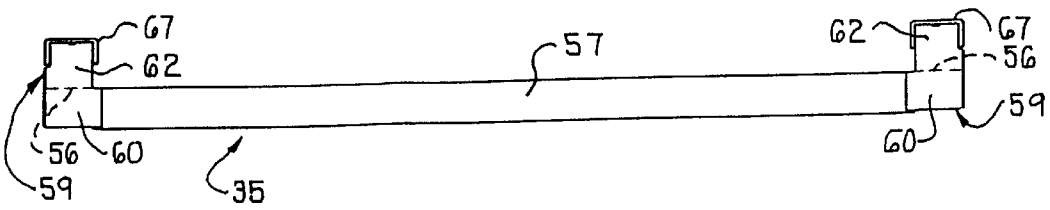
FIG. 5 is a plan view of the connector bracket.
Figure 3:
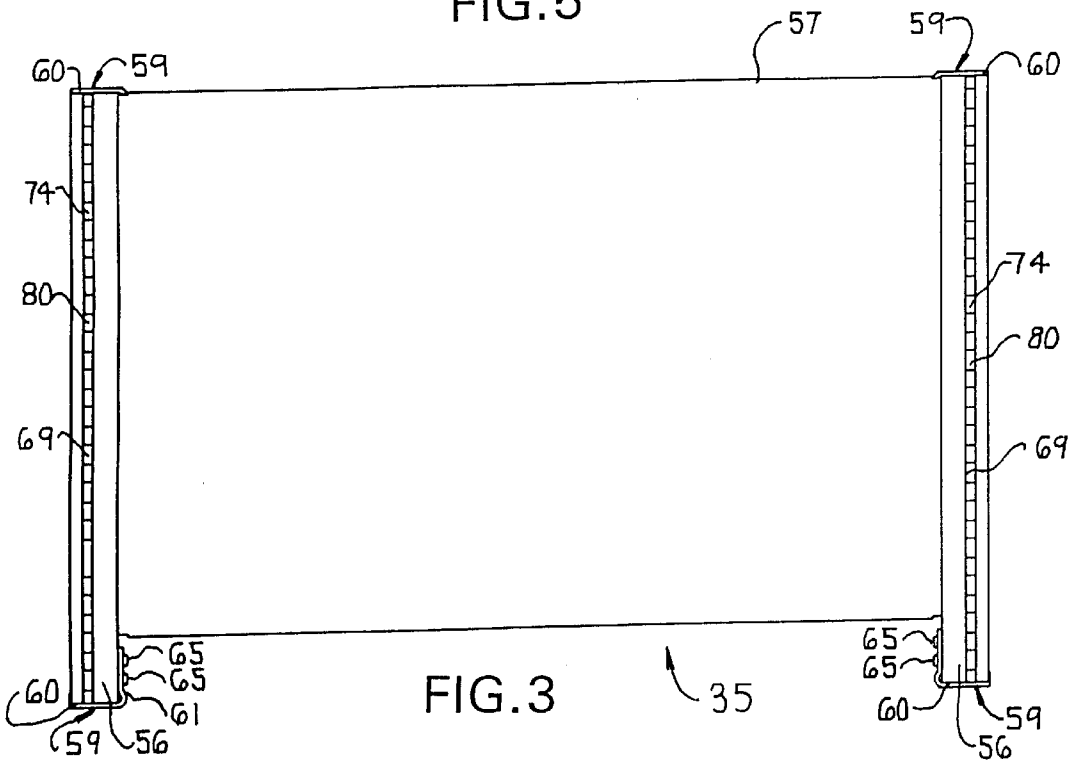
FIG. 3 is a front view of a connector bracket for supporting the furniture component.

Referring to FIGS. 3–5, the connector bracket 35 includes a pair of laterally spaced apart vertical rails 56 which are joined together by a rectangular support panel 57. The support panel 57 is rigid and defines the spacing for the vertical rails 56, and the length of the support panel 57 can be changed to accommodate different size furniture components.

To support or mount the connector bracket 35 on the wall panel 12, a hook 59 is removably connected to the top and bottom of each rail 56 wherein the hooks 59 define a furniture mounting arrangement. The hooks 59 are formed from plate steel, and as seen in FIG. 8, each hook 59 includes a cap section 60, a mounting flange 61, and a hook-like L-shaped extension 62 which extends away from the cap section 60. The cap section 60 overlies the end of the rail 56 when mounted thereon.

The mounting flange 61 is formed on either the left or right edge of the cap section 60 so as to lie against the interior surface of the rail 56. The mounting flange 61 includes holes 64 through which fasteners 65 (FIG. 3) are inserted to fasten the hooks 59 to the rails 56.To support the connector bracket 35 on the wall panel 12, the hook-like extension 62 is cantilevered so as to extend away from the rails 56. The extension 62 includes a vertical flange 66 on the end thereof which hooks over or engages a corresponding one of the channels 31 (FIG. 2).

Preferably, the top hooks 59 engage the uppermost channel 31 so that the furniture component 25 is supported, for example, at shoulder height which is a typical height for overhead storage cabinets. The hooks 59 also may be engaged with the channels 30 if a worksurface or shelf needs to be supported at beltline height.

Each flange 66 also includes a plastic cover 67 (FIG. 4) to facilitate sliding of the hook 59 along the channels 31. Thus, the furniture component 25 may be slid sidewardly to a desired position.

When the connector bracket 35 is mounted to the wall panel 12, the top hooks 59, for example, extend over and downwardly into the uppermost channel 31 while the bottom hooks 59 extend upwardly into the bottom channel 31 located below the uppermost channel 31. Thus, the connector bracket 35 cannot be dislodged during sliding, at least until the bottom hooks 59 are removed.

To support different types of furniture components, each of the vertical rails 56 is formed with a vertical channel 69 (FIG. 6) which preferably extends along the vertical length of the rail 56 and opens forwardly therefrom. Each channel 69 also opens vertically from its opposite ends. The rails 56 are formed identical to each other so as to be fastened to either the right or left edges of the support panel 57.

While the channel 69 is relatively narrow, the opposing interior side surfaces of the channel 69 are notched so as to define a plurality and preferably three slots 70, 71 and 72 (FIG. 6) along the vertical length thereof. As a result, each opposed pair of slots 70 defines an insert seat or mount for receiving an adapter insert 74. The remaining pairs of slots 71 and 72 define two additional insert seats for alternative inserts 74-1 or 74-2 as seen in phantom outline in FIG. 6. More or less slots may be provided to define additional insert seats. For example, a single insert seat can be provided which receives a plurality of different inserts therein.

Preferably, the innermost insert seat as defined by slots 70 has a greater width than the outer insert seats, although each insert seat may have the same width. When an insert 74 is positioned in one of the insert seats, the channel 69 thereby is divided into an opening 75 on an outer side of the insert 74 as seen in FIG. 6, and a clearance space 76 on the inner side thereof in which the end of a support part and specifically a hook 77 (FIG. 4) is received when the hook 77 is engaged with an insert 74. The hooks and slots thereby serve generally as connector parts.

The insert 74 is fixed within the channel 69 when the opposite open ends of the channel 69 are enclosed by the top and bottom hooks 59 that are secured to the rail. The insert 74 thereby can support the load of a furniture component 25. To add or change an insert 74, one of the hooks 59 is removed.

Figure 7B:
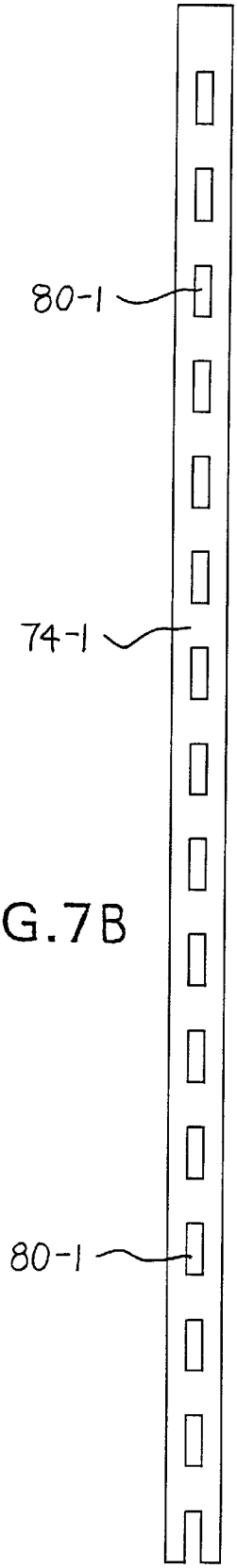
FIG. 7B is a front elevational view of a second insert for the vertical rail.

Each insert seat is adapted to receive a corresponding one of the inserts 74, 74-1 and 74-2 therein. One insert 74 is illustrated in FIG. 7. The insert 74 is a vertically elongate plate which is formed with a row of vertically spaced slots 80 preferably along the entire length thereof. The particular arrangement, size and spacing of the slots 80 corresponds to a known hook and slot arrangement, in particular, to receive a vertically-spaced arrangement of the hooks 77 (as seen in FIG. 4). When the insert 79 is slid into one open end of the rail channel 69, the slots 80 are accessible through the channel opening 75. As a result, a hook from a furniture component 25 can be inserted through the channel opening 75 into the slots 80 for securing the furniture component to the connector bracket 35.

The inserts 74-1 and 74-2 preferably are provided with alternative arrangements of slots 80-1 or other connector means to support different types of connector arrangements for furniture components. Thus, the insert 74 may be removed and one of the alternative inserts 74-1 or 74-2 is inserted into a corresponding one of the insert seats to accommodate a different mounting arrangements.

With this arrangement, the bracket 35 is compatible with a plurality of different types of furniture. Additionally, each rail 56 may also be provided with screw holes on the outer side thereof away from the support panel 57 so as to permit additional adapter pieces to be mounted to an exterior of the rail 56.

A rail similar to rail 56 could also be provided for securing return walls 15 to the wall panel 12, wherein the inserts would correspond to different connector methods for connecting the ends of wall panels together. However, due to the loads associated with return walls 15, the interface assembly 36 (FIG. 9) preferably is used instead.

The interface assembly 36 includes a mounting bracket 82 which is slidably connected to the channels 30 of the box-beam 19 as seen in FIG. 2. Referring to FIGS. 9 and 10, the mounting bracket 82 includes a support rail 83 which is vertically elongate and has a length corresponding generally to the height of the box-beam 19. The support rail 83 includes apertures 84 which are vertically spaced apart along the length thereof.

Figure 11:
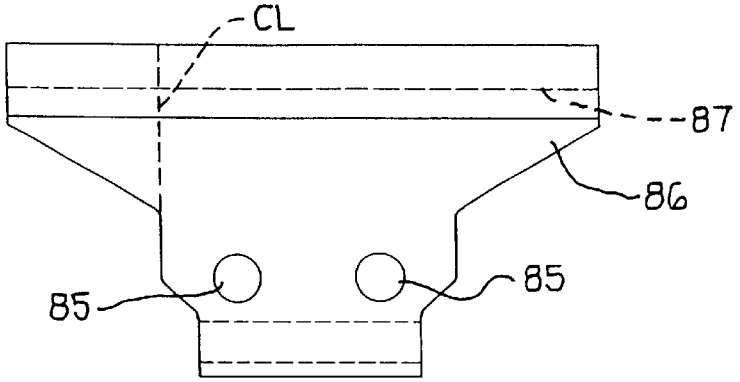
FIG. 11 is a plan view of a hook for the mounting bracket.

The support rail 83 also includes apertures at the top and bottom thereof which receive fasteners 85 for connecting hook plates 86 thereto. Referring to FIGS. 9–11, each hook plate 86 has flange 87 at the end thereof which is slidably received in a corresponding channel 30. The hook plates 86 thereby engage the channels 30 at the top and bottom of the box-beam 19 as seen in FIG. 9 so as to prevent dislodgement of the mounting bracket 82. The mounting bracket 82 thereby is connected to the box-beam 19 which is able to support significant loads. Since a return wall 15 is freestanding, the loads carried by the box-beam primarily will be the torsional loads from the return wall 15.

As seen in FIG. 11, the hook plate 86 has a width which is significantly larger than and approximately twice the width of the support rail 83. As a result, the torsional loads from the return wall 15 are more readily accommodated since the flanges 87 have a greater bearing area within the channels 30.

However, if the return wall 15 is to be placed at the end of a spine wall 14, the flange 87 can be shortened, for example, by shortening the hook plate 86 along cut line CL identified in FIG. 11.

Once the mounting bracket 82 is secured to the box-beam 19, an interface rail 91 is secured thereto by engaging suitable fasteners with the apertures 84 in the support rail 83. This interface rail 91 preferably is engagable with the specific connector arrangement provided on the specific type of wall panel being secured thereto. Thus, the interface rail 91 serves as an adaptor for connecting the return wall 15 to the mounting bracket 82.

Usually, the interface rail 91 will be significantly longer than the mounting bracket 82, usually extending to the top edge of the wall panel 12. This permits any connectors at the top of a return wall 15 to be connected to the interface rail 91.

To stabilize the interface rail 91, particularly when subjected to torsional loads, the interface assembly 36 preferably includes a locking device 93 which engages the wall panel 12. Preferably, the locking device 93 is located on the interface rail 91 near the channel 31 at the top of the base panel 12.

Figure 12:
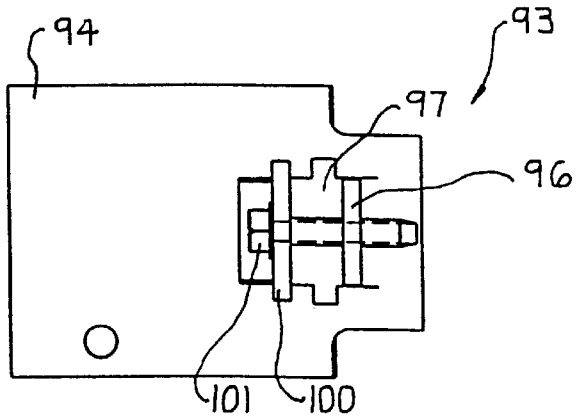
FIG. 12 is a top view of a locking device for the interface bracket.
Figure 13:
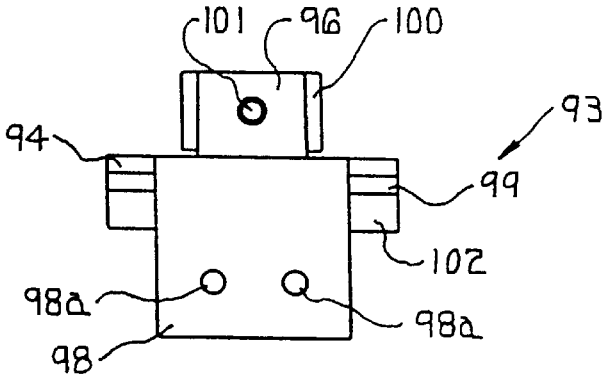
FIG. 13 is an end view of the locking device.
Figure 14:
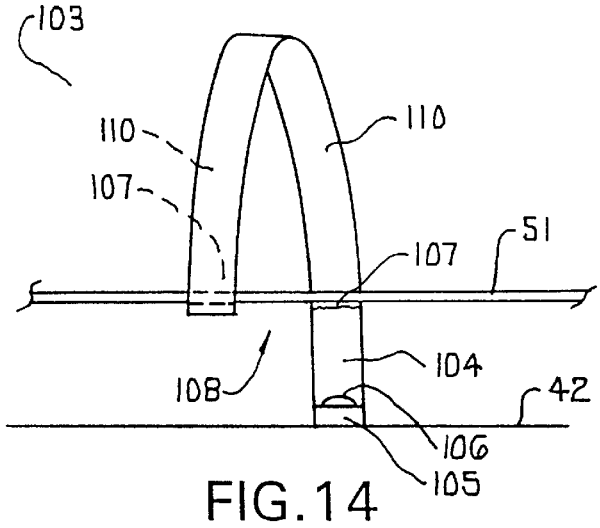
FIG. 14 is a front view of a wire-management cable ring for managing cables in the wall panel system.

The locking device 93 frictionally engages the side walls of the channel 31 so as to prevent movement of the interface assembly 36 and permit the return wall 15 to be adjusted to a vertical position. As seen in FIGS. 9, 12 and 13, the locking device 93 includes a fixed plate 94 having one end connected to the inside face of the interface rail 91, and the opposite end projecting horizontally to the channel 31.

The fixed plate 94 defines a fixed jaw 95 which extends downwardly into the channel 31 and is positioned therein so as to abut against one side wall thereof. The fixed plate 94 also includes an upstanding screw flange 96 and a T-shaped opening 97.

To secure the fixed plate 94 to the interface rail 91, the fixed plate 94 includes a depending mounting flange 98. The mounting flange 98 includes apertures **98*a* through which fasteners are engaged into the interface rail 91**.

The locking device 93 further includes a movable plate 99 which is slidably connected to the fixed plate 94. In particular, the movable plate 99 includes an upstanding screw flange 100 which is generally T-shaped so as to be wider at the top than the bottom. This screw flange 100 slides vertically through the widest section of the T-shaped opening 97, and then slides forwardly along the narrower portion of the opening 97.

An adjustment screw 101 is threadedly engaged with the spaced apart screw flanges 96 and 100. When the screw 101 is rotated, the movable plate 99 slides relative to the fixed plate 94 such that the screw flanges 96 and 100 move toward or away from each other, generally in the direction of reference arrow B.

To lockingly engage the channel 31, the movable plate 99 also includes a movable jaw 102 which extends downwardly into the channel 31. When the adjustment screw 101 is rotated, the jaws 95 and 102 spread apart until they press tightly against the side walls of the channel 31 in a brake-like arrangement. As a result, the jaws 95 and 102 frictionally engage the channel side walls and prevent lateral movement of the interface assembly 36 relative to the wall panel 12.

The locking device 93 thereby can support torsional loads from the return wall 15. Further, the return wall 15 may be set plumb and locked in place by the locking device 93.

Figure 15:
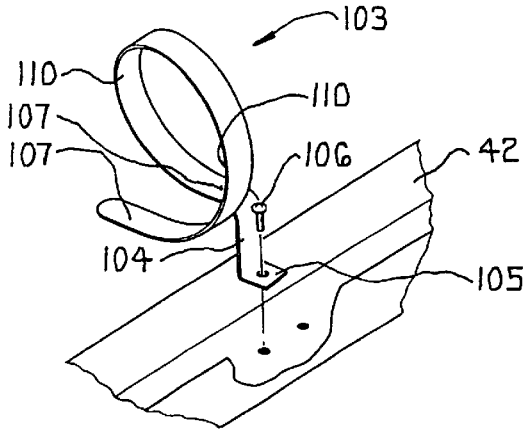
FIG. 15 is an exploded perspective view of the cable ring being mounted to a panel frame rail.

The wall panel system 10 includes an additional component, namely the cable ring 52. The cable ring 52 is formed from steel strapping which is formed into a generally circular spiral loop having a central opening 103. One end of the cable ring 52 is an upstanding base 104 having a mounting flange 105 which is secured to the cable support rail 42 by a screw 106 (FIG. 15).

Due to the spiral shape of the cable ring 52, support surfaces 107 are generally defined near the free end thereof and the base 104. The spiral shape also defines a space 108 laterally between the support surfaces 107.

Figure 16:
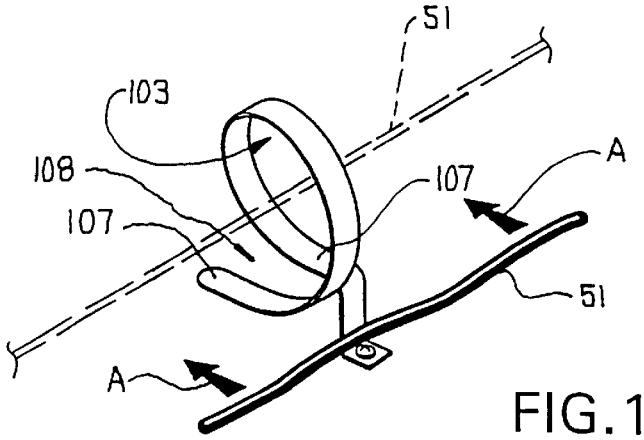
FIG. 16 is a partial perspective view of the cable ring.

With this arrangement, telecommunications cables 51 can be slipped into the opening 103 and vertically supported on the support surfaces 107 after the cabling is laid in the wall panel raceways. In particular, as seen in FIG. 16, the existing cable 51 is illustrated in solid just prior to being slid into the cable ring 52. Generally, the cable 51 is moved sidewardly in the direction identified by reference arrows A.

During this sideward movement, the section of the cable 51 located to the right of the space 108 slides directly onto to the rightward support surface 107. The left section of cable 51 meanwhile slides under and past the free end of the ring 52. Then the left section of the cable 51 is raised and brought back in a direction opposite to arrows A so that the cable 51 is laid on the leftward support surface 107 at the end of the cable ring 52.

While the support surfaces 107 vertically support the cable 51, the curved sides 110 of the cable ring 52 serve to center or maintain the cable 51 on the support surfaces 107. In particular, the curved sides 110 curve downwardly toward respective support surfaces 107 to urge the cable 51 in opposite sideward directions when it is disposed in the opening 103 which thereby tends to keep the cable 51 within the cable ring 51.

In operation, a plurality of wall panels 12 are arranged so as to define a central spine wall. This spine wall 14 may replace an existing central section of wall panels or in a new installation, be provided as the primary spine from which additional return walls 15 are connected. Typically, the return walls 15 may be constructed from a different type or brand of wall panels, particularly where the spine wall 14 replaces an existing central section of wall panel.

To accommodate the different types and brands of wall panel components, the interface bracket 36 is provided for the connection of the return walls 15 to the spine wall 14. First, the mounting bracket 36 is connected to the box-beam 19, and then an appropriate interface rail 91 is fastened thereto. The interface rail 91 has suitable connectors thereon so as to permit its connection to one or more specific types of wall panels.

The mounting bracket 82 can be slid sidewardly along a wall panel 12 to a desired position. At which time, the locking device 93 is engaged with the adjacent channel 31. In particular, the adjustment screw 101 is rotated until the locking jaws 95 and 102 are spread apart into frictional engagement with the opposing side walls of the channel 31. The locking device 93 thereby prevents sideward movement of the return wall 15 and also accommodates some of the torsional loads of the return wall 15.

Figure 17:
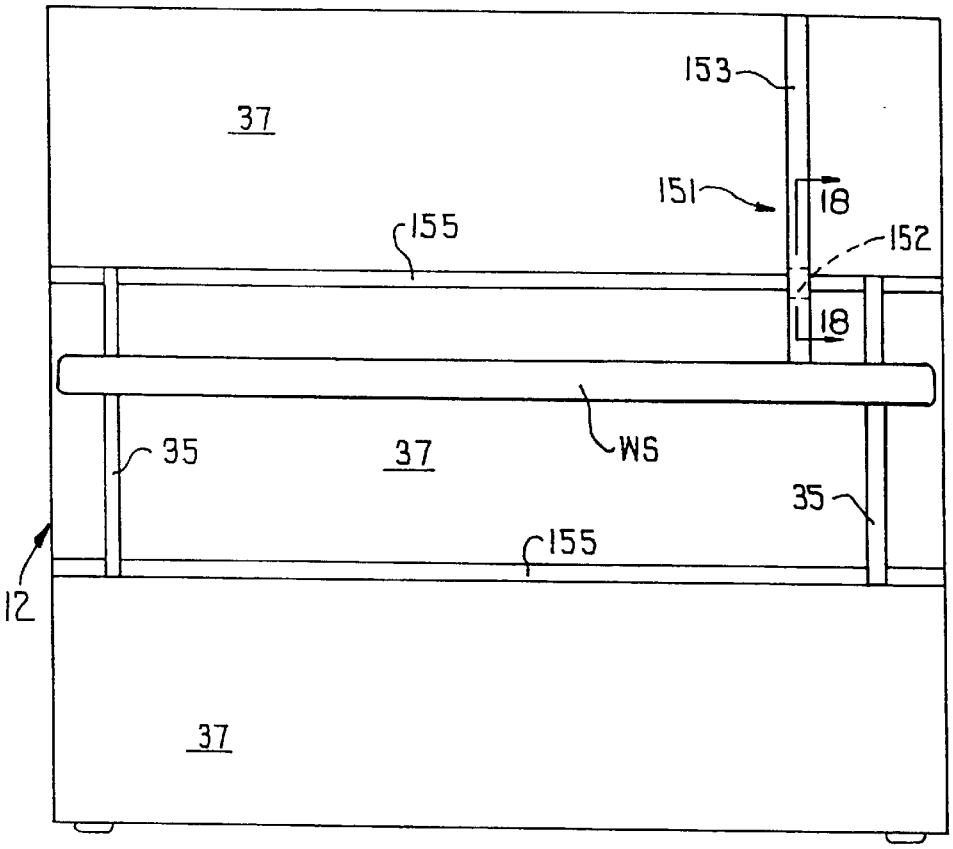
FIG. 17 is a front elevational view of a panel which illustrates mounting of an improved wire management arrangement thereon according to another aspect of the present invention.
Figure 18:
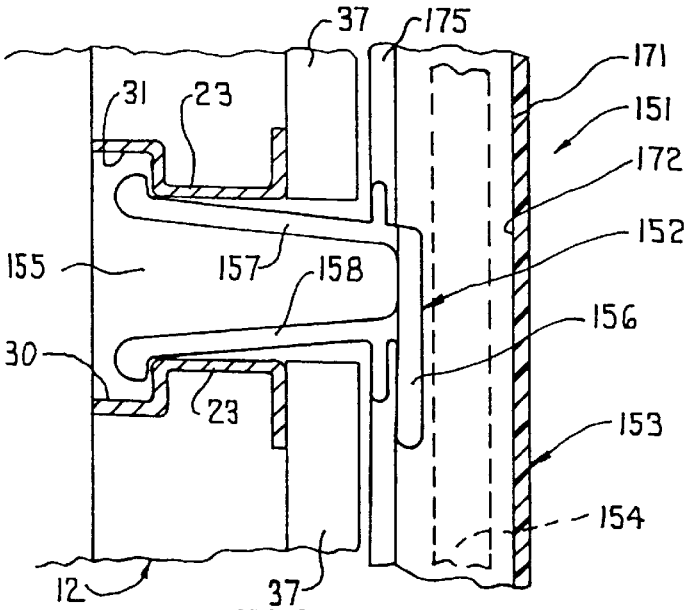
FIG. 18 is an enlarged fragmentary sectional view taken generally along line 18—18 in FIG. 17 and illustrating the mounting of the cable management arrangement on the panel.
Figure 19:
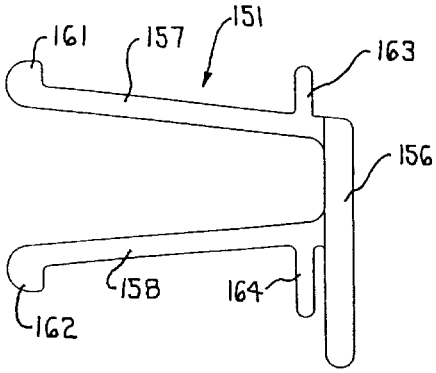
FIG. 19 is a side elevational view of the clip associated with the cable management arrangement.
Figure 20:
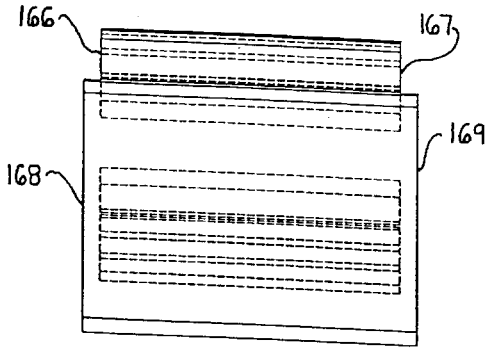
FIG. 20 is a front elevational view of the clip of FIG. 19.
Figure 22:
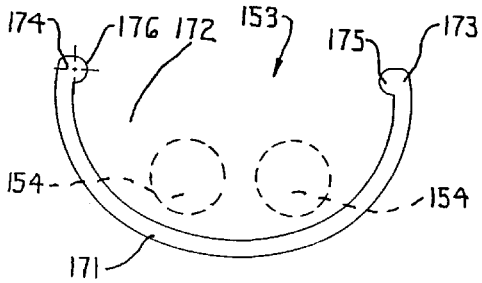
FIG. 22 is a cross section of the cover as taken generally along line 22—22 of FIG. 21.
Figure 21:
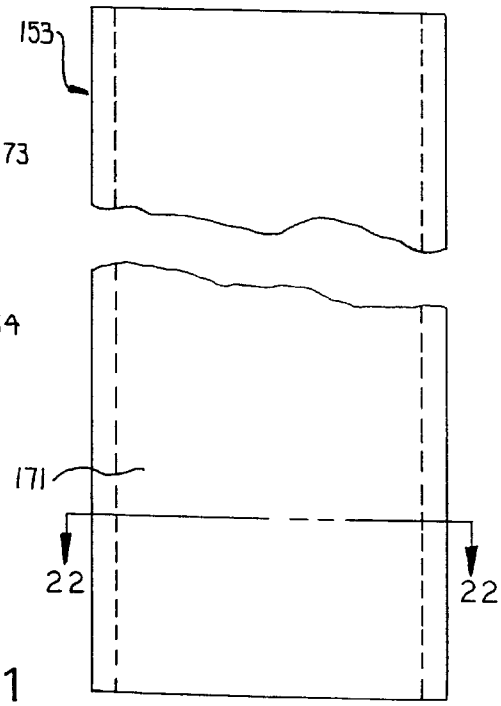
FIG. 21 is a front elevational view of the cover which mounts on the clip.

To support various furniture components on the wall panel 12 such as an overhead storage unit (FIG. 2) or a work surface WS (FIG. 17), the connector bracket 35 also is mounted to the wall panel 12. First, a suitable insert 74 is selected which corresponds to the particular hooks 77 (FIG. 4) on the furniture component 25. The insert 74, 74-1 or 74-2 is slid into an appropriate insert seat and is secured within the hollow interior of the bracket rail 56 by the top and bottom hooks 59. The hooks 59 secure the connector bracket 35 to the base panel 12, and then, the furniture component 25 is engaged with the rails 56 and in particular, the hooks 77 are slid into the corresponding slots 80 on the insert 74.

In addition to these bracket arrangements, an additional cable ring 52 is provided with in one of the raceways 38 or 39. Communication cable 51 or other types of cable are first laid into the raceways 38 or 39 and then slid sidewardly into the cable ring 52 as disclosed herein.

Referring now to FIGS. 17–22, there is illustrated a cable management arrangement 151 which releasably mounts on a face of the panel 12 to permit cables to be run vertically along the face thereof. The cable management arrangement 151 permits the cables to be controlled and enclosed, while enabling the cables to run vertically along the face of the panel, with the positioning of the cables being readily adjusted horizontally across the face of the panel.

More specifically, the cable management arrangement 151 includes a clip 152 which releasably snaps into and is slidable along any of the horizontally extending T-shaped grooves 155 which extend horizontally across the panel 12 and are defined between the opposed cross rails 23. The clip 152 is of a one-piece construction and includes a generally vertically oriented face plate 156 having a pair of legs 157–158 fixed to and cantilevered outwardly from the rear face thereof. The legs 157–158 are vertically spaced apart and, adjacent their rear free ends, are provided with respective projections 161–162 which project vertically away from one another in opposite directions. The legs 157–158 also are provided with vertically projecting flanges 163–164 which project transversely in opposite directions from the respective upper and lower faces of the upper and lower legs 157–158, respectively. These flanges 163–164 are generally vertically aligned and are disposed closely adjacent but spaced slightly rearwardly from the rear face of the face plate 156.

The legs 157–158 as well as the projections 161–162 and flanges 163–164 are provided with a significant horizontally-extending width, as defined between opposite side edges 166–167. These latter side edges, however, are spaced inwardly at least a small distance from the respective vertical side edges 168–169 of the face plate 156, the latter thus having a horizontal width which at least slightly exceeds the horizontal width of the legs.

The clip is preferably constructed in one piece of a plastics material, such as by being molded, and the material has sufficient elasticity as to permit the cantilevered legs 157–158 to be resiliently deflected vertically toward one another to facilitate their insertion into the T-shaped groove 155 as explained hereinafter.

As to the cover 153, it comprises a vertically elongate channel-shaped member 171 which defines therein an elongate interior channel or cavity 172 sized so as to accommodate one or more electrical cables or wires 154 therein. The cover member 171, in the illustrated embodiment, is of an arcuate curvature resembling a semi-circle, and the longitudinally-extending free edges 173–174 of the member 171 are provided with respective ribs or protrusions 175–176 extending longitudinally therealong. The ribs 175–176 project inwardly toward one another in generally opposed relationship, and are preferably provided with a rounded exterior configuration so as to facilitate the functioning of these protrusions as cams as well as locks.

The cable management arrangement 151 is used by first inserting the clip 152 into one of the T-shaped grooves 155. To accomplish this, the legs 157–158 are deflected inwardly toward one another so as to pass through the narrow portion of the groove 155 until the projections 161–162 align with and snap into the opposed channels 30–31, thereby resiliently securing the clip within the T-shaped groove. In this latter position, the leg flanges 163–164 are positioned directly adjacent the front of the panel, such as adjacent the outer surface of the tiles or covers 37, so as to effectively slide therealong. This thus results in the faceplate 156 being spaced adjacent but slightly outwardly from the front surface of the tiles or covers 37. The clip 152 can be horizontally slidably moved along the groove 155 so as to be positioned at the desired location.

Thereafter the wire management cover 153 is oriented vertically with the wires 154 disposed in the interior thereof, and then the cover 151 can be moved inwardly so that the ribs 175–176 engage the opposite side edges 168–169 of the face plate. Inward pressure on the cover causes the cover member 171 to sufficiently resiliently deflect so that the ribs 175–176 cam pass the side edges 168–169, and then snap into engagement behind the side edges 168–169, thereby securing the cover member 171 to the face plate 156. This securement, however, still enables the cover member 171 to be vertically slidably displaced relative to the face plate 156 so that it can be vertically arranged for covering the cables 154 as desired.

Since the cover member 171 is preferably constructed of a plastics material having at least limited resiliency, such as by being extruded, it will be appreciated that the cover member can be suitably cut to the desired length so as to accommodate the desired length of cable run.

With the arrangement as described above, the overall wire management arrangement can be displaced horizontally along the panel, and the cover itself can be vertically displaced. This thus enables the cover to be disposed so as to extend vertically from a base raceway to a worksurface WS if desired, or alternatively from a worksurface up to a position adjacent the upper edge of the panel, if desired.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. In a furniture arrangement comprising a furniture unit having an exposed exterior side surface and an elongate guide extending longitudinally along said side surface, said furniture arrangement further including a cable management assembly for managing cables extending across said side surface exterior of said furniture unit, said cable management assembly comprising a mounting clip which is mountable to said guide and movable longitudinally along a length of said guide in a first adjustment direction, said cable management assembly further including an elongate cover member having an interior channel extending along a length thereof which opens inwardly toward said side surface, said cover member being movably mounted to said mounting clip so as to extend in a second adjustment direction oriented transverse to said first adjustment direction and be movable in said second adjustment direction, said cover member extending beyond said mounting clip wherein an open channel portion of said interior channel overlies and is open toward a covered portion of said side surface to permit passage of cables through said open channel portion into said interior channel, said furniture unit including cables which extend across said side surface and are enclosed by said cover member wherein said cover member is adjustable in said first adjustment direction by repositioning of said mounting clip along said guide and is adjustable in said second adjustment direction by repositioning of said cover member relative to said mounting clip to vary the covered portion of said side surface which faces said open channel portion and permit repositioning of said cables on said side surface of said furniture unit.

2. The furniture unit according to claim 1, wherein said mounting clip is slidably connected to said guide so as to be continuously slidable therealong across said side surface.

3. The furniture unit according to claim 1, wherein said cover member is slidably connected to said mounting clip so as to be slidable in said second adjustment direction.

4. The furniture unit according to claim 3, wherein said mounting clip is slidably connected to said guide so as to be continuously slidable therealong.

5. The furniture unit according to claim 1, wherein said guide is an elongate channel which opens sidewardly and said mounting clip includes a mounting projection which fits within said channel and is repositionable along the length of said channel.

6. The furniture unit according to claim 1, wherein said furniture unit comprises an upright space-dividing wall panel, said guide extending generally horizontally and said cover member extending upwardly.

7. The furniture unit according to claim 1, wherein said furniture unit includes a work surface mounted thereon, said cover member having an open end which opens vertically towards an upper surface of said work surface, said cover member being displaceable away from said work surface in said second adjustment direction to permit said cables to be routed to said work surface, and being displaceable towards said work surface to enclose said cabling.

8. The furniture unit according to claim 1, wherein said furniture unit includes a hollow interior through which said cable is disposed, said guide being in open communication with said hollow interior along a length thereof to permit routing of said cable from said hollow interior to said channel of said cover member at multiple locations along the length of said guide.

9. The furniture unit according to claim 1, wherein said interior channel opens toward said side surface along substantially an entire length of said cover member.

10. The furniture unit according to claim 9, wherein said cover member permits laying of cables therein from an interior side of said cover member which overlies said side surface.

11. The furniture unit according to claim 1, wherein said open channel portion permits said passage of cables through said open channel portion which is disposed between opposite ends of said cover member.

12. A cable management system for an office, comprising:

a base unit defining a hollow interior which defines a raceway and includes cabling disposed therein, said base unit including an elongate guide on a side surface of said base unit which said guide is in open communication with said raceway along a length of said guide; and a cable management assembly comprising a mounting clip which is movably interconnected to said guide so as to be repositionable along the length thereof, and a cover member which is movably connected to said mounting clip, said mounting clip being displaceable in a first adjustment direction along the length of said guide and said cover member being displaceable relative to said mounting clip in a second adjustment direction oriented transverse to said first adjustment direction, said cover member extending beyond said mounting clip and having an interior channel which has an open portion which opens towards said side surface, said open portion being adapted to receive said cabling therethrough such said cabling is able to extend from said raceway through said guide to permit routing of said cables from said raceway into said channel.

13. The cable management system according to claim 12, wherein said interior channel of said cover member is open inwardly along a length thereof towards said side surface of said base unit and is open at opposite ends of said channel.

14. The cable management system according to claim 12, wherein said first adjustment direction extends horizontally and said second adjustment direction extends vertically such that repositioning of said mounting clip along said guide adjusts a lateral position of said cover member and adjustment of said cover member relative to said mounting clip adjusts an elevation of said cover member.

15. The cable management system according to claim 12, wherein said base unit is a wall panel.

16. The cable management system according to claim 12, wherein said guide is an interior channel having a longitudinal length which extends along said side surface of said base unit and has an open side which opens through said side surface.

17. The cable management system according to claim 16, wherein said mounting clip includes an insert section which fits into and is secured within said guide through said open side thereof, said insert section securing said mounting clip to said base unit while permitting sliding of said mounting clip along said guide.

18. A cable management system for an office comprising:

a wall unit; and a cable manager assembly comprising:

a mounting clip including a face member comprising an outer front surface, an inner back surface and opposite side edges, said mounting clip further including securing means projecting rearwardly from said back surface of said face member which are removably engaged with said wall; and an elongate cover which has an end portion extending beyond said mounting clip and an interior channel which extends longitudinally along a longitudinal direction, said interior channel having an open inner side defined by inner edge sections of said cover which said open side overlies a portion of said wall, said inner edge sections having protrusions which project toward each other and removably engage said opposite side edges of said face member in sliding engagement therewith to permit longitudinal displacement of said cover relative to said mounting clip when engaged one with the other.

19. The cable management system according to claim 18, wherein said cover member is resiliently deflectable to permit displacement of said protrusions laterally away from each other to permit snap-fitting engagement of said protrusions with said opposite side edges of said face member.

20. The cable management system according to claim 19, wherein said cover has a U-shaped cross-sectional shape in the longitudinal direction.

21. The cable management system according to claim 18, wherein said securing means comprise legs which project rearwardly of said face plate in cantilevered relation and are resiliently deflectable.

22. The cable management system according to claim 21, wherein said legs include projections spaced rearwardly of said face member which project in said longitudinal direction of said cover member in opposite directions away from each other to permit engagement with said wall.

23. The cable management system according to claim 18 wherein said mounting clip includes locator flanges which are spaced rearwardly of said back face of said face member to abut against an exterior surface of a wall to which said mounting clip in mounted and space said face member forwardly of said exterior surface to permit engagement of said cover to said opposite side edges of said face member.

* * * * *